US005779569A

United States Patent [19]

Townsend et al.

[11] Patent Number: 5,779,569

[45] Date of Patent: Jul. 14, 1998

[54] DIRECTIONAL BALL RETURN CHUTE

[76] Inventors: Linn Edward Townsend, P.O. Box 676, Nevada City, Calif. 95959; Daniel Lathe Townsend, 1722 Buchanan St., Marysville, Calif. 95901

[21] Appl. No.: 820,433

[22] Filed: Mar. 12, 1997

[51] Int. Cl.[6] ..... A63B 69/00

[52] U.S. Cl. ..... 473/433; 473/432; 473/488

[58] Field of Search ..... 473/432, 433, 473/488, 489; 273/395, 396

[56] References Cited

U.S. PATENT DOCUMENTS

| | | | |
|---|---|---|---|
| 922,630 | 5/1909 | Reach | 473/488 |
| 1,522,957 | 1/1925 | Kennedy | 473/488 |
| 1,765,269 | 6/1930 | Hatley | 473/433 |
| 3,814,421 | 6/1974 | Spier, Jr. | 473/433 |
| 3,945,638 | 3/1976 | Luebkeman . | |
| 4,579,339 | 4/1986 | Grimm | 473/433 |
| 4,613,135 | 9/1986 | Rush | 473/488 |
| 4,720,101 | 1/1988 | Farkas, Jr. | 473/433 |
| 4,815,734 | 3/1989 | Verhulst | 473/488 |
| 4,896,882 | 1/1990 | Coleman . | |
| 4,957,289 | 9/1990 | Kotlarz . | |
| 5,098,090 | 3/1992 | Juhl | 473/433 |
| 5,165,680 | 11/1992 | Cass | 473/433 |
| 5,184,814 | 2/1993 | Manning | 473/433 |
| 5,348,290 | 9/1994 | Matherne et al. . | |

*Primary Examiner*—Raleigh W. Chiu
*Attorney, Agent, or Firm*—Terrance L. Siemens

[57] ABSTRACT

A ball return chute for a basketball hoop, and a modular basket assembly utilizing the novel chute. The chute engages the hoop by C-shaped members which slip over the rod stock of the hoop at the slot formed in each C. The chute can be rotated three hundred sixty degrees about the hoop, so as to return a ball passing downwardly through the hoop in any selected direction. The basket assembly includes a bracket for permanent attachment to a vertical environmental surface. The bracket has hooks or equivalent receptacles for receiving trunnion arms formed in a member projecting from the hoop. The hoop may thus be removably supported in an operable position by the bracket. The hoop and attached chute are removed from and installed on the bracket when desired.

6 Claims, 1 Drawing Sheet

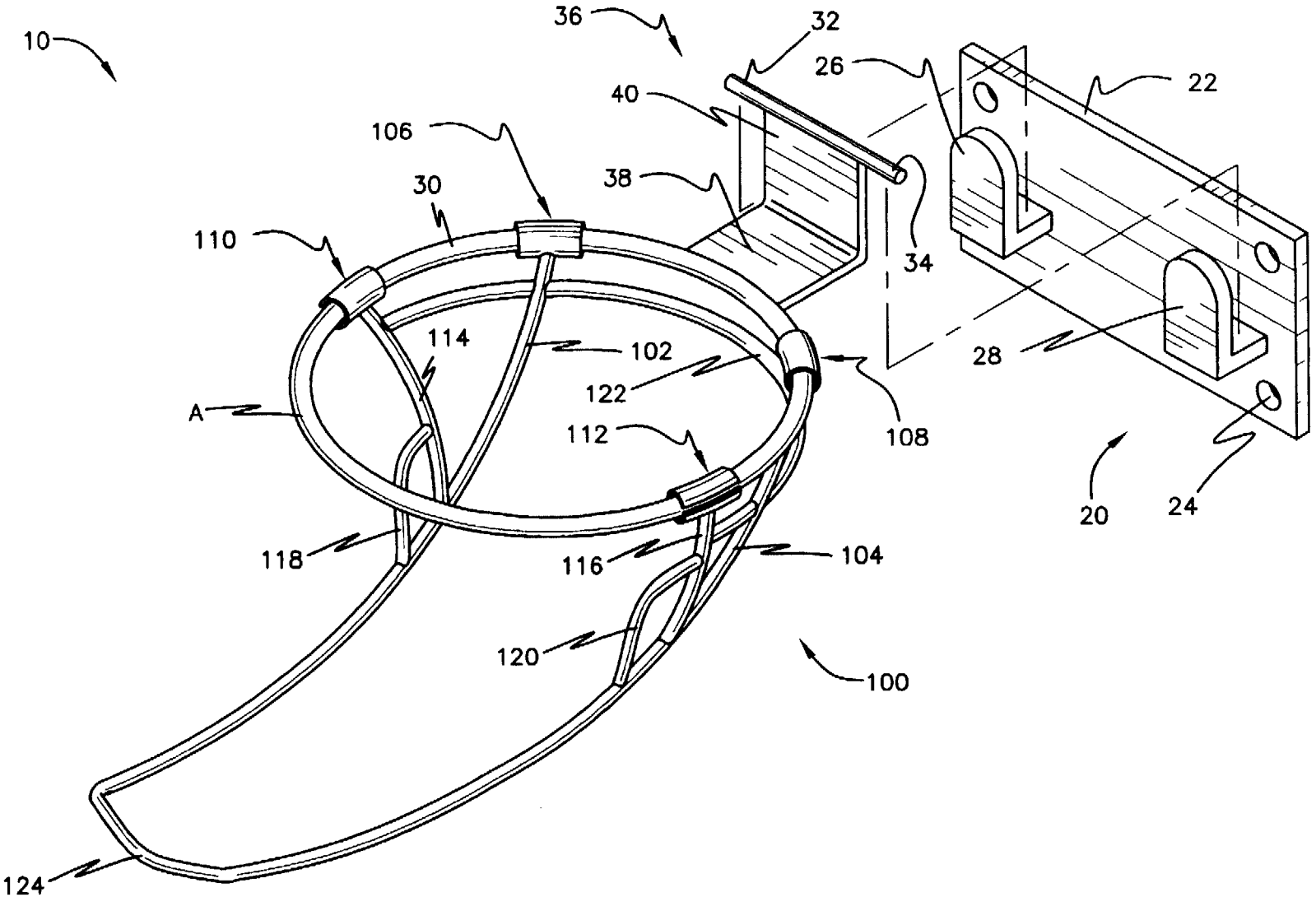
22
24
20
28
26
34
108
32
104
100
36
40
38
102
122
112
116
120
106
30
114
110
A
118
124
10

DIRECTIONAL BALL RETURN CHUTE

BACKGROUND OF THE INVENTION

1. Field of the Invention

The present invention relates to athletic equipment associated with sports requiring that a ball be thrown through a hollow target, such as the hoop of a basket for basketball. More specifically, the invention comprises a chute for returning a ball after the ball has passed through the hoop. The chute is adjustable as to the angle of projection of a returned ball.

2. Description of the Prior Art

Games such as basketball entail repetitive practice in shooting the ball through the basket. Different game situations must be practiced for a player to become adept at all phases of the game. In typical practice sessions, one or more players will attempt shots to the basket from different locations on a court beneath the basket.

A frequently occurring problem with shooting practice is that after each shot, the ball must be retrieved for the subsequent shot. When a shot successfully passes through the basket, the ball has a tendency to avoid returning to the shooter. While this is seemingly insignificant, it in fact delays subsequent practice shooting. Far more practice could be completed if the ball could be retrieved expeditiously.

The prior art has suggested apparatus for directing return of the ball following successful shots. Ability to effect return following an unsuccessful shot is limited due to the random trajectory or rebound direction following an unsuccessful shot. However, successful shots will predictably pass through the basket, after which the ball may be intercepted and directed to return in a predetermined direction.

To this end, the prior art has proposed chutes disposed beneath a basket. Some exemplary chutes are seen in U.S. Pat. Nos. 3,945,638, issued to Hart H. Luebkeman on Mar. 23, 1976, 4,896,882, issued to Brian L. Coleman on Jan. 30, 1990, 4,957,289, issued to Jeffery R. Kotlarz on Sep. 18, 1990, and 5,348,290, issued to Lonny R. Matherne et al. on Sep. 20, 1994. In each exemplary case, a chute is attached to a basket assembly or hoop.

The device of Matherne et al. is suspended from the basketball hoop by four downwardly open hooks. In the present invention, the chute engages the hoop by split sleeves which are outwardly open rather than downwardly open in the manner of Matherne et al. This characteristic enables the engagement members, or sleeves, to pass over a member attaching the hoop to its associated backboard. Therefore, adjustment throughout three hundred sixty degrees of rotation is enabled. By contrast, the device of Matherne et al. is limited to rotation of less than three hundred sixty degrees about the hoop by interference of the hooks with the attachment member.

In another difference, the return apparatus of Matherne et al. is potentially susceptible to being dislodged in an upward direction. This may occur under game conditions, when players jump during rebound retrieval. This is not possible with the present invention since openings of the split sleeves are oriented in different directions.

The devices of Luebkeman and Kotlarz are adjustable as to the angle of return of the ball. However, in the prior art devices, this adjustment is accomplished only by tedious manipulation of individual support hooks into respective eyes receiving these hooks. In addition to being time consuming, the angle of return is limited by availability and location of the eyes.

By contrast, in the present invention, adjustment is provided in infinitely adjustable increments. Rather than utilizing hooks and eyes, the present invention uses a split ring which passes over the hoop, partially encircling the same. The entire chute of the present invention may thus be rotated while mounted on the hoop, unlike the devices of Leubkeman and Kotlarz. The present invention can be used alone, without a traditional fabric or metallic net, or mounted independently beneath a conventional basketball net and hoop combination.

None of the above inventions and patents, taken either singly or in combination, is seen to describe the instant invention as claimed.

SUMMARY OF THE INVENTION

The present invention provides a ball return chute attachable to a basket for basketball. It improves over prior art ball return devices by its attachment to the hoop of the basket assembly. A plurality of arms extend upwardly from the chute to engage the hoop. These arms terminate in horizontally oriented, arcuate split sleeves. Slots formed at the splits are outwardly oriented.

In one example, the arms deflect resiliently to allow installation of each split sleeve onto the hoop. Alternatively, the sleeves may be rigid and assembled to the support hoop. The slot is sufficiently wide as to clear a plate attaching the hoop to the backboard. The return chute is thus rotatable three hundred sixty degrees about the hoop. Also, it cannot be dislodged from below by an upwardly directed or other impact.

In a further improvement, the novel chute has a readily engaged and separated bracket. The bracket has hooks which engage right and left ends of a horizontal trunnion affixed to the hoop. This feature enables the bracket, which is essentially two dimensional apart from the hooks having a nominal depth, to be permanently mounted to an environmental surface. The bracket may also serve as a backboard. The hoop and chute may be readily removed for storage and to prevent theft. The trunnion and its associated support arm are configured to exploit weight of the novel chute to maintain the chute and hoop appropriately positioned for shooting practice, such that the hoop is positioned by gravity.

The chute and its split sleeves cooperate with many standard basketball baskets, so that it may be retrofit to existing baskets in many cases. The split sleeves impinge only minimally upon conventional baskets, so that the game or practice therefor is not unduly affected by presence of the novel return chute.

While the present invention has been described with its application to the sport of basketball, it may nonetheless be utilized for other sports utilizing projectiles which are propelled into or through a goal or target. Even non-spherical projectiles, such as footballs, darts, hockey pucks, and badminton birdies may be returned utilizing the novel principles.

Accordingly, it is a principal object of the invention to provide apparatus attachable to the target of a ball game for returning a ball projected into or through the target.

It is another object of the invention to enable the apparatus to be rotatable with respect to the target through a range of three hundred sixty degrees.

It is a further object of the invention that the apparatus engage the target in such a manner as to resist being dislodged from engagement therewith by impacts.

Still another object of the invention is that the apparatus be compatible for mounting to a conventional basketball hoop and backboard.

An additional object of the invention is to provide a bracket enabling ready manual assembly and disassembly of a hoop to a supporting vertical environmental surface.

It is again an object of the invention that the apparatus avoid undue impingement to a conventional ball target.

Yet another object of the invention is to position a basketball hoop on a separate bracket by gravity.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawing.

BRIEF DESCRIPTION OF THE DRAWING

Various other objects, features, and attendant advantages of the present invention will become more fully appreciated as the same becomes better understood when considered in conjunction with the accompanying drawing, which is a perspective view of the invention, with a mounting bracket shown isolated from remaining components.

DETAILED DESCRIPTION OF THE PREFERRED EMBODIMENTS

Referring now to the drawing, the novel modular basket assembly 10 is seen to comprise a mounting bracket 20 for permanent attachment to a vertical environmental surface (not shown), a hoop 30 having attachment apparatus for manually and removably attaching hoop 30 to bracket 20 such that hoop 30 occupies a horizontal plane when bracket 20 occupies a vertical plane, and a directional ball return chute 100 providing a directionally adjustable ball return feature. Bracket 20 comprises a plate 22 preferably bearing holes 24 for accepting fasteners (not shown) for fastening bracket 20 to a wall or similar environmental surface, and two hooks 26, 28.

Hooks 26, 28 provide receptacles for receiving trunnion arms 32, 34 fixed to the upper end of an attachment member 36 for attaching hoop 30 to bracket 20. Attachment member 36 comprises a horizontal section 38 and a vertical section 40. Trunnion arms 32, 34 and vertical section 40 of attachment member 36 are coplanar at the right side of member 36, as shown in the drawing, so that attachment member will come to rest flush against bracket 20.

Configuration of attachment member 36 props hoop 30 in an operable position wherein hoop 30 occupies a horizontal plane when engaged with bracket 20 disposed in a vertical plane. Receptacles 26, 28 secure hoop 30 in place by gravity when trunnion arms 32, 34 are inserted therein. Hoop 30 is mounted to and readily removed from engagement with bracket 22 manually. No tools are required for assembly of hoop 30 to bracket 22, nor for disassembly therefrom.

Chute 100 is rotatably mounted on hoop 30 so as to be able to return a ball in a selected direction relative to hoop 30. Chute 100 has two side rails 102, 104 which form a trough disposed to guide a ball (not shown) to project in a lateral direction after passing through hoop 30 and falling vertically downwardly. Chute 100 is provided with connection apparatus for connecting chute 100 to hoop 30. Connection apparatus includes encirclement members 106, 108, 110, 112, partially encircling the constituent rod of hoop 30. Encirclement members 106, 108, 110, 112 occupy a common plane, so that they may all engageably cooperate with hoop 30 simultaneously.

Each encirclement member 106, 108, 110, or 112 is configured in cross section, or in end elevation, as being C-shaped. The C-shaped configuration includes a slot which is just great enough in width to enable horizontal section 38 of attachment member 36 to pass therethrough. This relationship enables chute 100 to be rotated one hundred eighty degrees about hoop 30, so that the horizontal direction of ball return may be adjusted in infinite increments.

All encirclement members 106, 108, 110, 112 are arranged to open outwardly and away from one another, such that their respective slots face in different directions. This arrangement prevents chute 100 from being dislodged from hoop 30 by an impact during play or practice, where the impact comprises a single directional vector component.

Connection arms 114, 116 each attach to chute 100 at one end and to one encirclement member 110 or 112, respectively, at the other end. The upper sections of side rails 102 and 104 perform dual duty, serving both to guide a ball being returned and also as connection arms for encirclement members 106, 108, thereby connecting chute 100 to hoop 30. Therefore, it may be said that there is one connection arm for each encirclement member 106, 108, 110, or 112, each connection arm attaching to chute 100 at one end and to one encirclement member 106, 108, 110, or 112 at its other end.

Chute 100 is reinforced by additional members for the purpose of maintaining configuration despite incidental manipulation which may occur under practice or game conditions. Members 118 and 120 connect the discharge end of chute 100 to the midpoints of connection arms 114, 116. Member 122, which is disposed beneath and generally parallel to hoop 30, connects connection arm 114, side rails 102 and 104, and connection arm 116, respectively. Member 124 maintains parallel spacing of side rails 102 and 104 at the discharge end of chute 100.

The present invention is susceptible to various modifications which may be introduced without departing from the spirit of the invention. Several examples will be set forth, it being recognized that still others may exist.

It would be possible to eliminate one connection arm 114 or 116, or, alternatively, to substitute one connection arm connecting to hoop 30 at a point A, in place of both connection arms 114 and 116. However, in the latter case, it would be desirable to route the resultant connection arm (not shown) such that it did not interfere with the path of a ball being returned. The resultant arm would be bent or otherwise configured to extend between point A and one rail 102 or 104 while avoiding interference. Therefore, it is preferred to provide two substantially straight connection arms 114, 116 each attached to only one side rail 102 or 104, each connection arm 114 or 116 being substantially straight, occupies a path of minimal distance between hoop 30 and one respective said side rail 102 or 104, and avoids interference with the path of the ball when the ball is being returned.

Rails 102, 104 may be replaced by an arcuate member (not shown), such as would result should a web of material span rails 102, 104. It will be understood that should chute 100 comprise such an arcuate member, then the two lateral edges of the resultant chute would provide a function equivalent to rails 102, 104 for purposes of attachment of connection arms 114, 116 and connection members 110, 112.

Trunnion arms 32, 34 are depicted as projecting outwardly from member 40. However, this arrangement could be replaced by a single wire or rod spanning hooks 26, 28 and extending back to hoop 30, joining hoop 30 at two spaced apart points. Therefore, attachment member 36 or its equivalent member in other embodiments (not shown) includes at least one member equivalent to trunnion arms 32, 34 which would cooperate with one or more receptacles for securing hoop 30 to bracket 22.

While the description of the preferred embodiment refers primarily to basketball, it will be appreciated that game targets other than basketball hoops or baskets may be modified to incorporate the inventive concept, and that projectiles other than basketballs may be returned from their respective targets by a return chute designed according to the inventive concept. The invention may be constructed of a combination of metallic and/or thermoplastic components. The invention may be designed and/or constructed from a plurality of materials which would allow for disassembly for compact storage and high density packaging. Further, the invention may have the ability to be mechanically, electrically or electromechanically rotated to remotely change the direction of the ball return.

It is to be understood that the present invention is not limited to the embodiments described above, but encompasses any and all embodiments within the scope of the following claims.

We claim:

1. A directional ball return chute for returning a ball thrown at a basketball hoop comprising:

a chute for returning the ball, said chute including two side rail members disposed to guide the falling ball in a lateral direction connection means for attaching said chute to the basketball hoop, said connection means including at least two encirclement members, said encirclement members being disposed in a common plane, said encirclement members being arranged to open outwardly and away from one another, said encirclement members being C-shaped in cross section, and where said encirclement members are disposed to engage the basketball hoop; whereby said chute is attached to the basketball hoop by the engagement of said encirclement members, said chute is prevented from dislodgement from the impact of a basketball impacting the hoop, and the basketball is directed in a chosen direction by said chute.

2. The directional ball return chute according to claim 1, wherein each said side rail member is attached to one of said encirclement members.

3. The directional ball return chute according to claim 1, wherein said connection means further includes a connection arm, said connection arm being attached at one end to each said encirclement member and said connection arm being attached at the other end to said chute; whereby said connection arm serves as an additional part of said chute to direct the thrown ball in the chosen direction.

4. A modular basketball hoop apparatus comprising:

mounting bracket for attachment to an environmental surface, said mounting bracket comprising a substantially planar plate and said mounting bracket including hoop portion attachment means;

hoop portion adapted to fit into hoop portion attachment means of said mounting bracket, said hoop portion being disposed such that when attached to said mounting bracket, said hoop portion is perpendicular thereto; and a directional ball return chute including a chute for returning the ball, said chute including two side rail members disposed to guide the falling ball in a lateral direction from said hoop portion, said directional ball chute also including connection means for attaching said chute to said hoop portion, said connection means including at least two encirclement members, said encirclement members being disposed in a common plane, said encirclement members being arranged to open outwardly and away from one another, said encirclement members being C-shaped in cross section, and where said encirclement members are disposed to engage said hoop portion; whereby said mounting bracket may be fixed to an environmental surface, said hoop portion is attached to said hoop portion attachment means of said mounting bracket and said chute is attached to said hoop portion by the engagement of said encirclement members, said chute is prevented from dislodgement from the impact of a basketball impacting said hoop portion, and the basketball is directed in a chosen direction by said chute.

5. The modular basketball hoop apparatus according to claim 4, wherein said hoop portion includes a bracket engagement means, said bracket engagement means comprising a first attachment member and a second attachment member, said first attachment member being disposed perpendicularly to said mounting bracket plate, said first attachment member including a pair of laterally disposed trunnion arms, and said second attachment member being disposed parallel to said mounting bracket plate and where said mounting bracket hoop portion attachment means comprises a pair of hooks for engaging said laterally disposed trunnion arms.

6. The modular basketball hoop apparatus according to claim 5, wherein said C-shaped encirclement members are sized such that first attachment member passes therethrough when said chute is rotated about said hoop portion.

* * * * *